United States Patent [19]

Buxton et al.

[11] Patent Number: 5,061,230

[45] Date of Patent: Oct. 29, 1991

[54] METHOD OF CONTROLLING BULK IN FOLDED WEBS

[75] Inventors: Gerry Buxton; Larry Wierschke; James E. Hertel, all of Green Bay, Wis.

[73] Assignee: Paper Converting Machine Company, Green Bay, Wis.

[21] Appl. No.: 604,009

[22] Filed: Oct. 26, 1990

[51] Int. Cl.[5] ..... B65H 45/00

[52] U.S. Cl. ..... 493/25

[58] Field of Search ..... 493/8, 10, 12, 22, 23, 493/24, 25, 26, 410, 411, 412, 413, 424, 425, 426, 427, 428, 429, 430, 431–433, 397, 398, 399, 418; 83/881, 73, 359; 270/39

[56] References Cited

U.S. PATENT DOCUMENTS

| | | | |
|---|---|---|---|
| 1,015,580 | 1/1912 | Nichols | 493/430 X |
| 2,359,417 | 10/1944 | Hand | 493/430 |
| 3,640,521 | 2/1972 | Hutley | 493/25 |
| 3,770,264 | 11/1973 | Sturman et al. | 493/25 X |
| 4,204,669 | 5/1980 | Nystrand | 493/430 |
| 4,227,683 | 10/1980 | Spangler et al. | 493/10 |
| 4,406,648 | 9/1983 | Cavagna et al. | 83/881 X |
| 4,504,051 | 3/1985 | Bittner et al. | 493/412 X |
| 4,824,426 | 4/1989 | DuFresne | 493/346 |

FOREIGN PATENT DOCUMENTS

| | | | |
|---|---|---|---|
| 0100064 | 6/1983 | Japan | 493/405 |

*Primary Examiner*—William E. Terrell
*Assistant Examiner*—John A. Marlott
*Attorney, Agent, or Firm*—Tilton, Fallon, Lungmus & Chestnut

[57] ABSTRACT

A method of controlling stack back pressure in folding apparatus incorporating sensing the bulk of a stack issuing from folding rolls, forming a signal corresponding to the sensed bulk, comparing the signal with a predetermined signal range and changing the size of an embossing nip gap or pressure whenever the signal is outside of the range.

8 Claims, 1 Drawing Sheet

Fig. 1
PRIOR ART
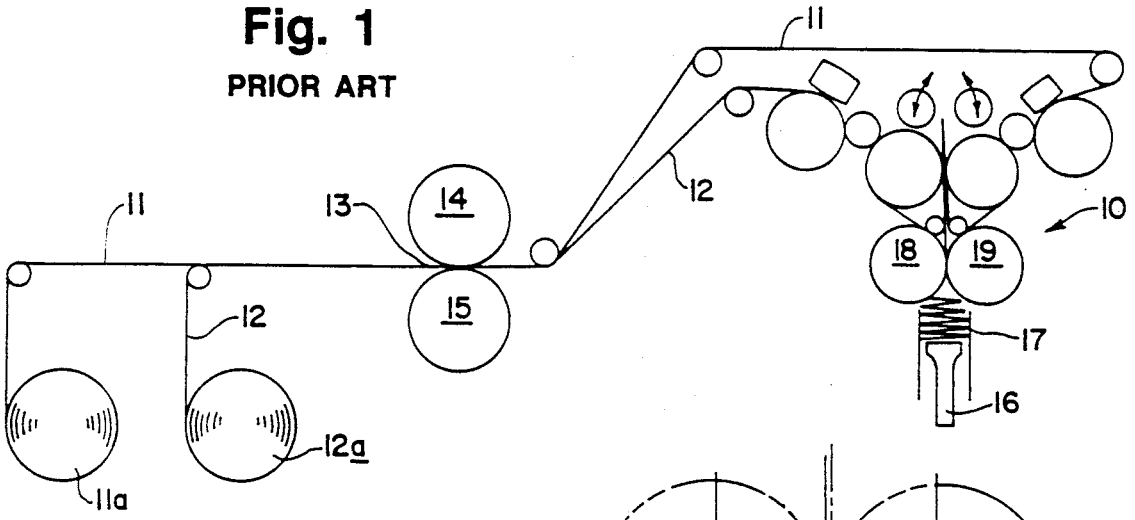
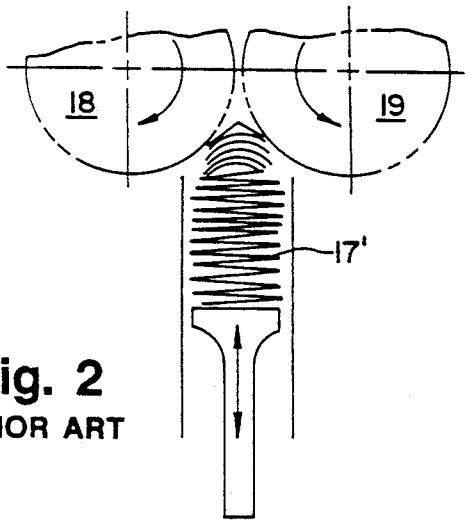
Fig. 2
PRIOR ART
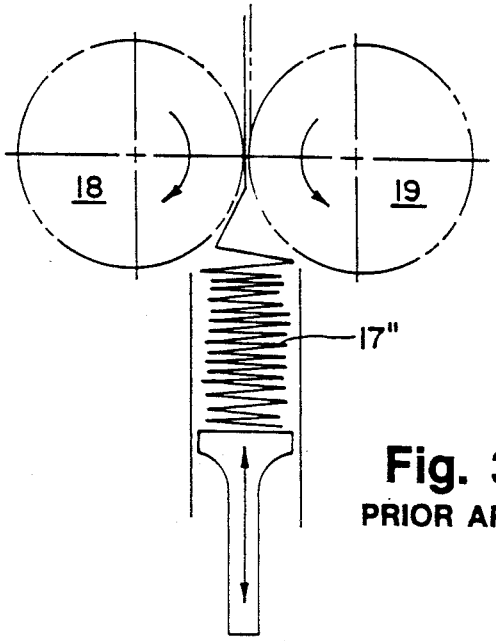
Fig. 3
PRIOR ART
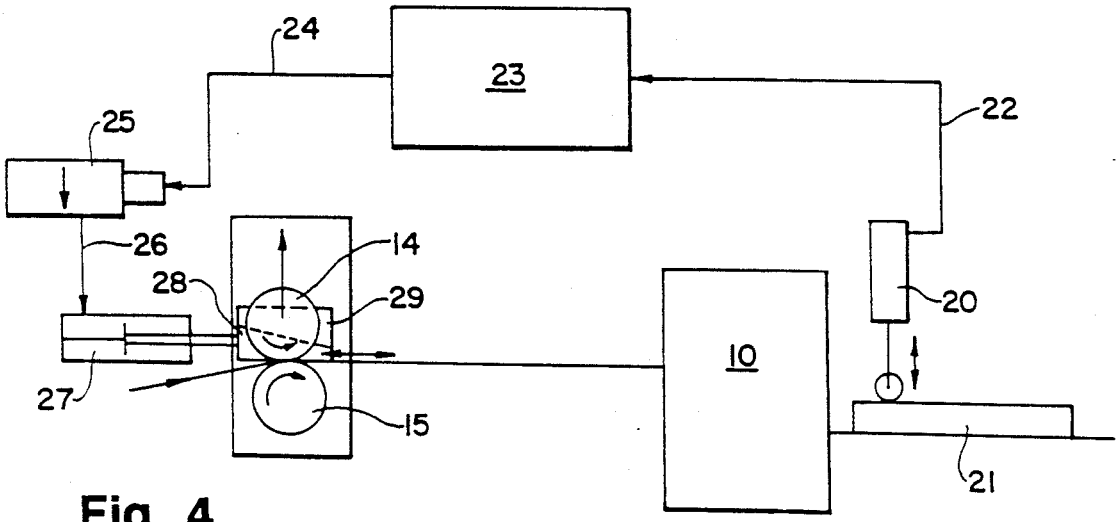
Fig. 4

METHOD OF CONTROLLING BULK IN FOLDED WEBS

BACKGROUND AND SUMMARY OF INVENTION

This invention relates to method of controlling bulk in folded webs and, more particularly, to the control of a folder line producing embossed interfolded webs.

Representative of a folder useful in the practice of this invention is that seen in co-owned U.S. Pat. No. 4,824,426. These are normally employed for towels, facial tissue, etc. Problems frequently arise in the folding back pressure at the folder outlet which results in improperly finished stacks. Although efforts have been made in the past to control stack back pressure by the operators —as by adjusting the nip in the embossing rolls —this has not proved successful because of the constant attention required to compensate for changes in web characteristics.

According to the invention, we overcome this drawback by sensinq the bulk of a bolt or stack issuing from the folder, forming a signal corresponding to the bulk of the bolt sensed, comparing the signal with a predetermined signal range and changing the nip gap or pressure in the embossing rolls whenever the signal is outside of the predetermined range.

Other objects and advantages of the invention may be seen in the details of the ensuing specification.

BRIEF DESCRIPTION OF DRAWING

The invention is described in conjunction with an illustrative embodiment in the accompanying drawing, in which —

FIG. 1 is a side elevational view, somewhat schematic, of a folder line useful in the practice of the invention;

FIGS. 2 and 3 are fragmentary enlarged side elevational views showing stack distortion characteristic of the prior art; and FIG. 4 is a schematic diagram of equipment employed in the practice of the invention.

DETAILED DESCRIPTION

In the illustration and with reference first to FIG. 1, the numeral 10 designates generally an interfolder into which a pair of webs 11 and 12 are fed. The webs 11 and 12 issue from parent rolls 11*a* and 12*a* which are supported on suitable unwind stands C shown). The webs are drawn through a nip 13 between embossing rolls 14 and 15. The rolls making up the folder 10 are driven and suitable other pull rolls (not shown) can be provided. For further details of the folder, reference can be made to the above-identified U.S. Pat. No. 4,826,426. In accordance with conventional practice, all of the rolls are supported between suitable side frames (not shown).

The embosser includes embossing rolls 14, 15 and may take a variety of forms but serve to deform the web or webs and increase the caliper or net thickness thereof. The amount of caliper increase depends upon the height/depth of the embossing pattern in the rolls and the proximity of the rolls. Such rolls may be of the "mating" type (i.e., steel/steel or paper/steel) or of the "conforming" type (i.e., rubber/steel). The amount of caliper increase is determined by the embosser nip gap (spacing) or nip pressure (conforming).

After passing through the folder 10, the web or webs are supported on an elevator 16 in the form of a stack or bolt 17 as the web or webs issue from the folding rolls 18, 19.

During the folding, it is critical that the top of the forming stack presses lightly against the folding rolls 18, 19 so that the next sheet onto the stack is partially decelerated by the last sheet on the stack.

Two types of improper operation can occur. As illustrated in FIG. 2, a stack 17' has too high a back pressure of the stack top against the folding rolls. In this case, the webs slip off of the folding rolls prematurely and the stack builds up between the rolls as illustrated in FIG. 2. On the other hand, when the stack back pressure is too low as at 17' (see FIG. 3), the stability of the stack top and the folded sheet in process is very poor, usually causing very poor stack quality and misaligned sheets.

By using the stack bulk (i.e., the spring-like quality of the stack) as a measure of back pressure, the embosser nip can be opened or closed to increase or decrease the web caliper and, hence, increase or decrease the stack height. Two ways may be employed to sense bulk. One is to move a probe downwardly toward the stack a predetermined distance and measure the force necessary to achieve this. The other is to move a probe downwardly at a constant force and measure the stack height when the constant force fails to move the probe further. Either may be employed although the first method is preferred in establishing bulk whereby the compressive force exerted on the stack increases up to the pre-established depth of penetration of the sensing probe.

In FIG. 4 an embosser nip control system is schematically illustrated to control the nip between the embossing rolls. This is accomplished through a stack bulk sensor generally designated 20 which measures the bulk (force or height) of a bolt or stack issuing from the folder elevator on an output conveyor 21. The stack bulk sensor delivers a signal via line 22 to a position controller 23. The position controller 23 incorporates logic to compare the signal with a predetermined signal range and, when the input signal in the line 22 is outside of the range, delivers an output signal along line 24 to position means 25.

In the illustration given, the position means 25 is an electro-hydraulic valve which delivers a signal via line 26 to a cylinder and piston rod unit 27 coupled to wedge blocks 28 at both ends of the upper embossing roll 14. By moving the lower wedge blocks 28 one way or the other, the upper wedge blocks 29 which are connected tot he bearings of the upper embossing roll 14, are raised or lowered and size 4 the nip 13 is controlled.

Once a bulk setting is made, the stack bulk is monitored and if the bulk of the stack does not lie within the predetermined range, the embosser wedge blocks are again moved until the stack bulk returns within the prescribed operating zone. As long as the stack bulk remains in this zone, no embosser correction is made. However, when the sensed bulk is outside the established range, there is incremental movement of the nip adjusting means while the embosser is running to bring the bulk into the proper range. An alternate method for incrementally adjusting the nip is to employ a low displacement cam and cam follower with the cam shaft rotation controlled by a servo motor and the cam follower connected to the embossing roll frames.

In some instances, it may be advantageous to measure the bulk of both ends of the tsp of the stock and the embosser correspondingly adjusted to keep the bulk of the web constant from side to side. The same sensing method is employed but by stopping and sampling the trailing end of the stack. The correction logic for the embosser positioners in such a case is duplicated identically.

Two significant benefits from the invention are (1) improved folder efficiency —fewer jams —and (2) better downstream processing due to consistent height stack.

While in the foregoing specification a detailed description of an embodiment of the invention has been set down for the purpose of illustration, many variations in the details hereingiven may be made within the spirit and scope of the invention.

We claim:

1. A method of controlling bulk in embossed, folded web stacks, comprising:

advancing web material through the nip between embossing rolls, advancing said web material through a folder onto an elevator to form it into a series of stacks of a predetermined count of folded web material layers and moving said stocks folded web material onto a horizontal conveyor, sensing the bulk of a stack on said conveyor, forming a signal corresponding to the bulk of the stack sensed, comparing said signal with a predetermined signal range, and changing the nip gap or pressure between said embossing rolls whenever said signal is outside said range.

2. The method of claim 1 in which the step of advancing web material includes advancing two webs through said nip.

3. The method of claim 1 in which the step of changing the gap or pressure of said nip includes repositioning incremental nip adjusting mean sat the ends of one of aid embossing rolls.

4. The method of claim 1 in which the step of providing a predetermined bulk range of a stack is performed prior to operating said folder and introducing said range into a comparing controller.

5. The method of claim 1 in which the said sensing step includes moving a probe downwardly toward a stack a predetermined distance and sensing the force necessary for such movement when said probe is stopped.

6. The method of claim 1 in which said sensing step includes moving a probe downwardly toward a stack at a constant force and sensing the height when said probe is stopped.

7. The method of claim 1 in which said sensing step includes exerting a compressive force on said stack.

8. The method of claim 1 in which said sensing step includes sampling the bulk at positions on the stack top corresponding to the longitudinal side edge portion of said web material and changing the nip gap or pressure separately on the two ends of the embossing rolls.

* * * * *